US010385490B2

(12) United States Patent
Ito et al.

(10) Patent No.: US 10,385,490 B2
(45) Date of Patent: Aug. 20, 2019

(54) METHOD FOR MANUFACTURING BINDER-CONTAINING INORGANIC FIBER MOLDED BODY

(71) Applicant: MITSUBISHI CHEMICAL CORPORATION, Chiyoda-ku (JP)

(72) Inventors: Toshio Ito, Niigata-ken (JP); Hidetaka Ito, Niigata-ken (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 0 days.

(21) Appl. No.: 15/526,179

(22) PCT Filed: Nov. 17, 2015

(86) PCT No.: PCT/JP2015/082252
§ 371 (c)(1),
(2) Date: May 11, 2017

(87) PCT Pub. No.: WO2016/080388
PCT Pub. Date: May 26, 2016

(65) Prior Publication Data

US 2017/0327984 A1 Nov. 16, 2017

(30) Foreign Application Priority Data

Nov. 19, 2014 (JP) ..... 2014-234649

(51) Int. Cl.

| | |
|---|---|
| ***D04H 1/64*** | (2012.01) |
| ***B05D 1/30*** | (2006.01) |
| ***B05D 1/28*** | (2006.01) |
| ***B05D 1/02*** | (2006.01) |
| ***B05D 1/18*** | (2006.01) |
| ***B05D 3/04*** | (2006.01) |
| ***B05D 7/24*** | (2006.01) |
| ***B05D 3/02*** | (2006.01) |
| ***D04H 1/4209*** | (2012.01) |
| ***D04H 1/58*** | (2012.01) |

(52) U.S. Cl.
CPC ..... *D04H 1/64* (2013.01); *B05D 1/02* (2013.01); *B05D 1/18* (2013.01); *B05D 1/28* (2013.01); *B05D 1/30* (2013.01); *B05D 1/305* (2013.01); *B05D 3/0254* (2013.01); *B05D 3/0413* (2013.01); *B05D 3/0493* (2013.01); *B05D 7/24* (2013.01); *D04H 1/4209* (2013.01); *D04H 1/58* (2013.01); *B05D 2203/30* (2013.01)

(58) Field of Classification Search
CPC ..... D04H 1/64; D04H 1/58; D04H 1/4209; B05D 1/02; B05D 1/18; B05D 1/28; B05D 1/30; B05D 1/305; B05D 3/0493; B05D 3/0254; B05D 3/0413; B05D 7/24; B05D 2203/30
See application file for complete search history.

(56) References Cited

U.S. PATENT DOCUMENTS 5,837,621 A * 11/1998 Kajander ..... C03C 25/26 442/143
5,869,142 A * 2/1999 Joachim ..... C03C 25/34 427/314

FOREIGN PATENT DOCUMENTS

| | | | |
|---|---|---|---|
| EP | 2 602 368 | A1 | 6/2013 |
| JP | 58-138631 | A | 8/1983 |
| JP | 2001-316965 | A | 11/2001 |
| JP | 2002-38379 | A | 2/2002 |
| JP | 2005/021945 | A1 | 3/2005 |
| JP | 2005-74243 | A | 3/2005 |
| JP | 2014-202187 | A | 10/2014 |
| WO | WO 97/32118 | A1 | 9/1997 |

OTHER PUBLICATIONS

Extended European Search Report dated Jul. 27, 2017 in Patent Application No. 15862017.9.
International Search Report dated Feb. 16, 2016 in PCT/JP2015/082252 filed Nov. 17, 2015.

* cited by examiner

*Primary Examiner* — William P Fletcher, III
(74) *Attorney, Agent, or Firm* — Oblon, McClelland, Maier & Neustadt, L.L.P.

(57) ABSTRACT

A main object of the present invention is to provide a method for manufacturing a binder-containing inorganic fiber molded body where localization of the binder is inhibited. The present invention achieves the object by providing a method for manufacturing a binder-containing inorganic fiber molded body including steps of: a binder solution coating step of coating an inorganic fiber molded body with a binder solution, and a liquid coating step of coating the inorganic fiber molded body coated with the binder solution with a liquid of which boiling point is less than 120° C.

20 Claims, 3 Drawing Sheets

METHOD FOR MANUFACTURING BINDER-CONTAINING INORGANIC FIBER MOLDED BODY

TECHNICAL FIELD

The present invention relates to a method for manufacturing a binder-containing inorganic fiber molded body. In more specific, the present invention relates to a method for manufacturing a binder-containing inorganic fiber molded body useful as a catalyst support of an exhaust gas purifier and a holding material of a particle filter.

BACKGROUND ART

One of the usages of inorganic fiber molded bodies represented by ceramic fibers is as holding materials for exhaust gas purifiers exposed to a high temperature condition such as industrial thermal insulation materials, refractory materials, and packing materials; upon storing the catalyst supports or the particle filters in the casings made of metal, the materials are wound around the catalyst supports or the particle filters, and then installed between the catalyst supports or the particle filters and the casings.

It is general to allow inorganic fiber molded bodies to contain organic binders and inorganic binders in order to prevent the fibers from spreading during its assembling work.

For example, Patent Document 1 discloses a method for manufacturing an inorganic fiber molded body wherein an inorganic fiber mat is impregnated with an organic binder solution; thereafter the inorganic fiber mat is compressed in the thickness direction, and the thickness of the inorganic fiber mat is restrained to remove a liquid medium of the organic binder solution. Also, Patent Document 2 discloses a method for manufacturing a resin-impregnated inorganic fiber mat, wherein an inorganic fiber mat is impregnated with a resin solution, thereafter dried by throw-flowing hot air in the thickness direction of the inorganic fiber mat. Patent Document 3 discloses a method for manufacturing a holding material, wherein a fiber material mat is impregnated with latex (an organic binder solution); the content of the organic binder in the internal circumference of the mat is in a range of 15 to 50 g/m$^2$ that is larger than the content of the organic binder in an external circumference of the mat.

CITATION LIST

Patent Documents

Patent Document 1: Japanese Patent Application Laid-Open (JP-A) No. 2002-038379

Patent Document 2: JP-A No. 2001-316965

Patent Document 3: JP-A No. 2005-074243

SUMMARY OF INVENTION

Technical Problem

Examples of the method known for impregnating an inorganic fiber mat with a binder solution may include spraying as described in Patent Documents 1 and 3. However, when the method is spraying a binder solution, the binder solution is not easily permeated to inside the inorganic fiber mat, although the solution is permeated to the surface of the inorganic fiber mat; as the result, the obtained inorganic fiber molded body contains the binder only partially on the surface.

Also, in manufacturing a binder-containing inorganic fiber molded body, it is known that, at the time of drying the inorganic fiber mat after the mat is impregnated with the binder solution, the binder is transferred to the surface of the mat concurrently with the solvent and the dispersion medium of the binder solution transferring to the surface, and thus the binder is localized on the surface of the inorganic fiber mat after the drying, which means that so called migration occurs.

In this manner, in an inorganic fiber molded body with the binder localized on its surface, intercalation may occur on the surface where the difference in the binder concentration is large in the thickness direction, and the intercalation can lead to destroy the inorganic fiber molded body. In particular, a generally applied method for assembling an exhaust gas purifier is a style of pressing a catalyst support or a particle filter wounded around by an inorganic fiber molded body in a casing; in this press-in style, large shearing force is applied to the inorganic fiber molded body, so that the problem of the intercalation becomes evident.

Also, in the press-in style, if the binder is localized on the surface of the inorganic fiber molded body, an adhesive force between the inorganic fiber molded body and the casing made of metal becomes so high that friction resistance becomes rather high; problems caused thereby may include such that the inorganic fiber molded body is wrinkled when being pressed-in, the catalyst support or the particle filter is slipped from the specific position, and the press-in load becomes too large.

Further, if the binder is localized on the surface of the inorganic fiber molded body, when the inorganic fiber molded body is wounded around the catalyst support or the particle filter, breakages and wrinkles may appear in the surface layer that contains the binder of the inorganic fiber molded body, and thus restraining the bulkiness of the inorganic fiber molded body can be difficult.

If the inorganic fiber molded body and the catalyst support or the particle filter are not stored in the specific positions inside the casing, favorable performance cannot be exhibited.

None of the techniques described in Patent Documents 1 to 3 intends to inhibit localization of the binder, but the above-described problems are unsolved.

The present invention is made in view of the problems, and the main object thereof is to provide a method for manufacturing a binder-containing inorganic fiber molded body where the localization of the binder is inhibited.

Solution to Problem

To solve the problems, the inventors of the present application thoroughly studied and as a result, found out that the localization of the binder was inhibited by coating an inorganic fiber molded body with the specific liquid after coating thereof with a binder solution.

That is to say, the present invention provides a method for manufacturing a binder-containing inorganic fiber molded body comprising steps of: a binder solution coating step of coating an inorganic fiber molded body with a binder solution; and a liquid coating step of coating the inorganic fiber molded body coated with the binder solution with a liquid of which boiling point is less than 120° C.

In the present invention, the inorganic fiber molded body coated with the binder solution is coated and impregnated with the specific liquid, so that the binder may be moved from the surface of the inorganic fiber molded body coated with the binder solution to the opposite side surface or the inside, and thus the localization of the binder may be inhibited.

Also, in the present invention, the liquid is preferably coated on a surface of the inorganic fiber molded body, the surface being coated with the binder solution, in the liquid coating step. In this case, a binder concentration may be decreased on the surface of the inorganic fiber molded body coated with the binder solution; as the result, the segregation of the binder to the surface of the inorganic fiber molded body may be inhibited in the drying step. Also, the binder solution may be permeated to the inorganic fiber molded body along with the liquid permeating thereto, so that the inorganic fiber molded body may contain the binder uniformly in the thickness direction.

Further, the present invention preferably comprises a drying step of drying the inorganic fiber molded body after the liquid coating step, wherein the inorganic fiber molded body is through-flow dried in the drying step. The reason therefor is to inhibit the migration of the binder at the time of drying the inorganic fiber molded body.

Also, the present invention preferably comprises a deliquoring step of removing the liquid from the inorganic fiber molded body after the liquid coating step, wherein one surface of the inorganic fiber molded body is coated with the binder solution in the binder solution coating step, the liquid is coated on a surface of the inorganic fiber molded body, the surface being coated with the binder solution, in the liquid coating step, and the liquid is absorbed from an opposite side surface of the inorganic fiber molded body coated with the binder solution and the liquid, in the deliquoring step. The reason therefor is to move the binder solution from the surface of the inorganic fiber molded body coated with the binder and the liquid to the opposite side surface, concurrently with the liquid moving from the surface of the inorganic fiber molded body coated with the binder solution and the liquid to the opposite side surface, so that the inorganic fiber molded body may contain the binder uniformly in the thickness direction.

Further, in the present invention, a coating method of the binder solution is preferably a noncontact coating style in which the inorganic fiber molded body is coated with the binder solution without contact. A noncontact coating style such as a spray coating alone has difficulty permeating the binder solution to inside the inorganic fiber molded body. In contrast, the present invention inhibits the localization of the binder as described above; thus the present invention is useful for noncontact coating styles.

Also, in the present invention, a coating amount ratio of the liquid is preferably in a range of 3.0 to 50 with respect to a solid amount of the binder on the surface of the inorganic fiber molded body coated with the binder. If the coating amount of the liquid is too small, it is difficult to equalize the binder. In addition, if the coating amount of the liquid is too large, the drying condition could be an excessive load.

Further, in the present invention, a coating amount of the liquid is preferably in a range of 7.5% to 80% with respect to a mass per inorganic fiber in the inorganic fiber molded body. The coating amount of the liquid is in the range, so that a dust generation amount of the binder-containing inorganic fiber molded body to be manufactured may be decreased, a shearing coefficient may be increased, and a friction coefficient may be decreased, and the drying condition does not become an excessive load.

Advantageous Effects of Invention

The present invention produces effects such as to obtain a binder-containing inorganic fiber molded body with high shear strength and a low friction resistance to a case made of metal, since the localization of the binder may be inhibited by coating the inorganic fiber molded body with a specific liquid after coating the inorganic fiber molded body with a binder solution.

DESCRIPTION OF EMBODIMENTS

The method for manufacturing the binder-containing inorganic fiber molded body of the present invention will be hereinafter described in details.

The method for manufacturing the binder-containing inorganic fiber molded body of the present invention is a method comprising steps of: a binder solution coating step of coating an inorganic fiber molded body with a binder solution; and a liquid coating step of coating the inorganic fiber molded body coated with the binder solution with a liquid of which boiling point is less than 120° C.

The method for manufacturing the binder-containing inorganic fiber molded body of the present invention will be described with reference to the drawings.

Figure 1A:
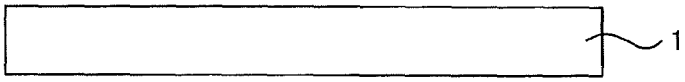
FIGS. 1A to 1E are process diagrams showing an example of the method for manufacturing the binder-containing inorganic fiber molded body of the present invention.
Figure 1B:
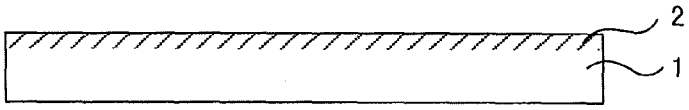
Figure 1C:
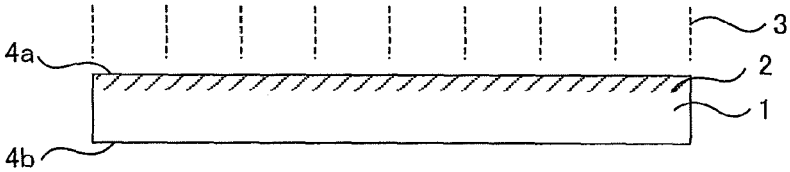
Figure 1D:
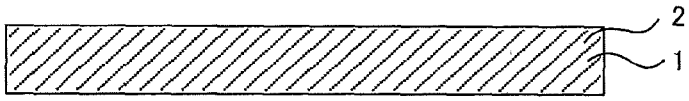
Figure 1E:
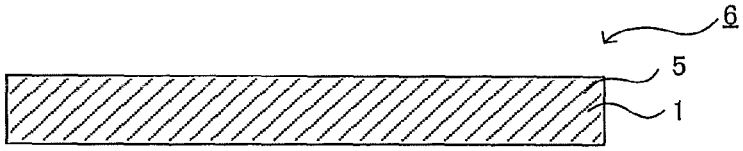

FIGS. 1A to 1E are process diagrams showing an example of the method for manufacturing the binder-containing inorganic fiber molded body of the present invention. First, as shown in FIG. 1A, sheet-like inorganic fiber molded body 1 is prepared; then, as shown in FIG. 1B, one surface of inorganic fiber molded body 1 is coated with binder solution 2. Next, as shown in FIG. 10, specific liquid 3 is sprayed to the surface of inorganic fiber molded body 1 coated with binder solution 2, to impregnate inorganic fiber molded body 1 with liquid 3. On this occasion, a concentration gradient occurs on surface 4*a* of inorganic fiber molded body 1 coated with binder solution 2 and opposite side surface 4*b*, so that the binder moves from surface 4*a* coated with binder solution 2 to opposite side surface 4*b*. After that, as shown in FIG. 1D, inorganic fiber molded body 1 coated with binder solution 2 and liquid 3 is dried. Thereby, as shown in FIG. 1E, binder-containing inorganic fiber molded body 6, in which binder 5 is included in inorganic fiber molded body 1, is obtained.

Incidentally, in FIG. 1C, surface 4*a* of inorganic fiber molded body 1 coated with binder solution 2 is coated with liquid 3; however, although not illustrated, when opposite side surface 4*b* to surface 4*a* coated with binder solution 2 of inorganic fiber molded body 1 is coated with liquid 3, the binder is also moved from the surface 4*a* coated with binder solution 2 to opposite side surface 4*b* by the concentration gradient when inorganic fiber molded body 1 is coated and impregnated with liquid 3.

Also, although not illustrated, when the both surfaces of inorganic fiber molded body 1 are coated with binder solution 2, the binder is moved from the both sides of inorganic fiber molded body 1 coated with binder solution 2 to the inside by the concentration gradient if inorganic fiber molded body 1 is coated and impregnated with liquid 3.

In these manners, in the present invention, the inorganic fiber molded body coated with the binder solution is coated and impregnated with the specific liquid so that the binder may be moved from the surface of the inorganic fiber molded body coated with the binder solution to the opposite side surface or the inside. Accordingly, the localization of the binder may be inhibited and equalized. Further, when the surface of the inorganic fiber molded body coated with the binder solution is coated with the liquid, a binder concentration may be decreased on the surface of the inorganic fiber molded body coated with the binder solution; as the result, the segregation of the binder to the surface of the inorganic fiber molded body may be inhibited in the drying step. Thus, the binder-containing inorganic fiber molded body with high shear strength and a low friction resistance to a case made of metal may be stably manufactured. Accordingly, the binder-containing inorganic fiber molded body of the present invention is excellent in assembling properties where the slippage of the binder-containing fiber molded body and a catalyst support or a particle filter when being pressed-in is inhibited, and thus the holding force of the binder-containing fiber molded body may be improved.

Figure 2:
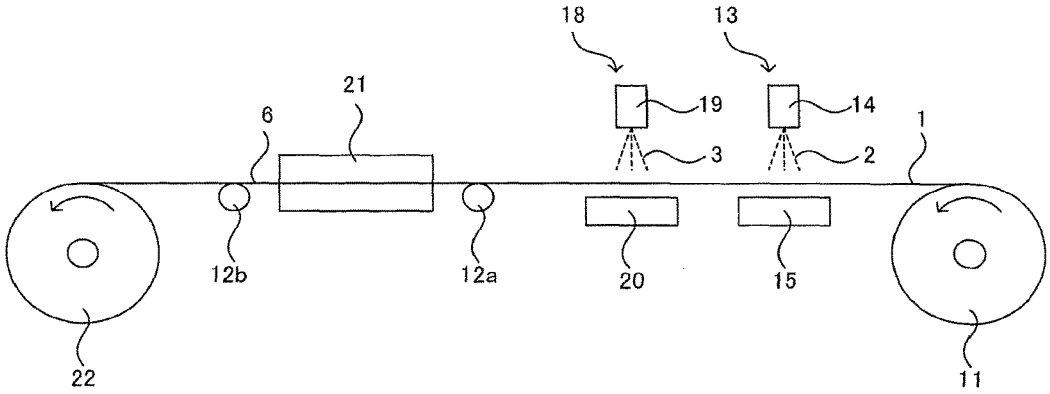
FIG. 2 is a schematic diagram showing additional example of the method for manufacturing the binder-containing inorganic fiber molded body of the present invention.

FIG. 2 is a schematic diagram showing additional example of the method for manufacturing the binder-containing inorganic fiber molded body of the present invention. This example is a manufacturing method in a roll-to-roll style using long inorganic fiber molded body 1. First, inorganic fiber molded body 1 wound in a roll shape is fed from feeding roll 11 and carried to spraying device 13. Spraying device 13 is disposed on the opposite side surface to spray nozzle 14 for spraying binder solution 2 and to the surface of inorganic fiber molded body 1 coated with binder solution 2, has liquid receiving pan 15 for collecting excessive binder solution 2 sprayed, and sprays binder solution 2 to one side of inorganic fiber molded body 1 by spray nozzle 14. Next, inorganic fiber molded body 1 coated with binder solution 2 is carried to spraying device 18. Spraying device 18 has spray nozzle 19 for spraying liquid 3 and absorbing device 20 for absorbing liquid 3 from the opposite side surface of inorganic fiber molded body 1 to the surface coated with liquid 3, and sprays liquid 3 to the surface of inorganic fiber molded body 1 coated with binder solution 2 by spray nozzle 19. On this occasion, sprayed liquid 3 may be moved inside inorganic fiber molded body 1 by absorbing device 20. Subsequently, inorganic fiber molded body 1 coated with binder solution 2 and liquid 3 is carried to drying device 21 by guide roll 12*a* to dry inorganic fiber molded body 1. Thereby, binder-containing inorganic fiber molded body 6, in which binder 5 is contained in inorganic fiber molded body 1, is obtained. After that, binder-containing inorganic fiber molded body 6 is carried by guide roll 12*b* and wound by winding roll 22.

The method for manufacturing the binder-containing inorganic fiber molded body of the present invention will be hereinafter described in each step.

1. Inorganic Fiber Molded Body

In the present invention, the inorganic fiber molded body is an assembly of nonwoven fabric of inorganic fibers, such as those called mats, blankets, or blocks.

The inorganic fibers comprising the inorganic fiber molded body is not particularly limited, and examples thereof may include silica, alumina/silica, zirconia including these, solo spinel or titania, or composite fiber. Above all, alumina/silica-based fiber is preferable, and crystalline alumina/silica-based fiber is particularly preferable. A composition ratio (mass ratio) of alumina/silica in the alumina/silica-based fiber is preferably in a range of 60 to 98/40 to 2, and more preferably in a range of 70 to 74/30 to 26.

An average fiber diameter of the inorganic fiber is preferably in a range of 3 μm to 8 μm, particularly preferably in a range of 5 μm to 7 μm. If the average fiber diameter of the inorganic fiber is too large, a repulsive force of the inorganic fiber molded body could be lost; if the average fiber diameter is too small, a dust generation amount to be floated in the air could be large.

The method for manufacturing the inorganic fiber molded body is not particularly limited, and a known arbitrary method may be applied. Above all, the inorganic fiber molded body is preferably the one subjected to a needling treatment. The needling treatment allows the inorganic fibers comprising the inorganic fiber molded body to entangle each other so as to manufacture a strong inorganic fiber molded body, and to adjust a thickness of the inorganic fiber molded body.

The thickness of the inorganic fiber molded body is not particularly limited, and appropriately selected in accordance with factors such as its usage. For example, the thickness of the inorganic fiber molded body may be about 2 mm to 50 mm.

The inorganic fiber molded body may be a single piece of sheet cut from a long sheet in a width direction, and may be a continuous sheet, which is long. If the inorganic fiber molded body is long, a binder-containing inorganic fiber molded body may be manufactured by a roll-to-roll style; thus, the productivity may be improved.

2. Binder Solution Coating Step

In the present invention, a binder solution coating step of coating the inorganic fiber molded body with a binder solution is conducted.

Both organic binders and inorganic binders may be used as the binder to be included in the binder solution. Above all, at least an organic binder is preferably used. In this case, only organic binders may be used, and a combination of an organic binder and an inorganic binder may be used. An organic binder may be decomposed and removed by heating, so that the repulsive force of the inorganic fiber molded body may be restored by heating, decomposing, and removing the organic binder upon using the binder-containing inorganic fiber molded body; thus, the binder-containing inorganic fiber molded body may be favorably used as a holding material for an exhaust gas purifier for example.

As the organic binder, for example, various rubber, water-soluble polymer compounds, thermoplastic resins, and thermosetting resins may be used. Above all, synthetic rubber such as acrylic rubber and nitrile rubber; water-soluble polymer compounds such as carboxymethyl cellulose, and polyvinyl alcohol; or acrylic resins are preferable. In particular, acrylic rubber, nitrile rubber, carboxymethyl cellulose, polyvinyl alcohol, and acrylic resins not included in the acrylic rubber are preferable. These organic binders may be favorably used since they are easily obtained or the solution thereof is easily prepared, the operation of coating the inorganic fiber molded body is easy, the binders exhibit a sufficient thickness restraining force even with a comparatively low content, the molded body to be obtained is flexible and excellent in strength, and the binders are easily decomposed and burned out under the condition of a working temperature. The organic binder may be used in one kind alone, and may be used in a combination of two kinds or more.

Examples of the inorganic binder may include inorganic oxides, and specific examples thereof may include alumina, spinel, zirconia, magnesia, titania, calcia, and materials having a composition of the same quality as that of the inorganic fibers. The inorganic binder may be used in one kind alone, and may be used in a combination of two kinds or more.

A particle diameter of the inorganic oxide may be 1 μm or less for example.

Solvents and dispersion mediums to be included in the binder solution are appropriately selected in accordance with the kind of the binder and the binder solution, and examples thereof may include water and organic solvents. Solvents and dispersion mediums may be used in one kind alone, and may be used in a combination of two kinds or more.

As the binder solution, if an organic binder is used, the organic binder including aqueous solution, water dispersion type emulsion, latex, or organic solvent solution may be used. These are commercially available, and these organic binder solutions may be used as they are or used by diluting them by dilute solutions such as water, and thus favorably used to coat the inorganic fiber molded body with the organic binder solution. In particular, the emulsion is preferable. The organic binder solution may contain an inorganic binder.

Also, if an inorganic binder is used, the binder solution to be used may be the inorganic binder including sol, colloid, slurry, and solution. The inorganic binder solution may contain an organic binder. Also, a dispersion stabilizer to increase stability of the inorganic binder may be added to the inorganic binder solution. Examples of the dispersion stabilizer may include acetic acid, lactic acid, hydrochloric acid, and nitric acid.

The binder concentration in the binder solution may be to the extent that the inorganic fiber molded body may be uniformly coated with the binder solution, and appropriately adjusted in accordance with the kind of the binder and the coating method. For example, the binder concentration in the binder solution is preferably in a range of 3 mass % to 50 mass %. If the binder concentration is too low, it is difficult to set the content of the binder in the binder-containing fiber molded body to be in a desired range. Also, if the binder concentration is too high, the inorganic fiber molded body is not easily impregnated with the binder; thus, working properties and several properties of the binder-containing inorganic fiber molded body such as a heat characteristic and strength could be degraded.

The coating method of the binder solution is not particularly limited if the method is capable of uniformly coating the inorganic fiber molded body with the binder solution, and may appropriately selected from general coating methods such as a kiss coating method, a spraying method, a dipping method, a roll coating method, a gravure coating method, a die coating method, and a curtain coating method. The binder solution may be repeatedly coated multiple times.

Above all, the coating method is preferably a contact coating style in which the inorganic fiber molded body is coated with the binder solution by contact, or a noncontact coating style in which the inorganic fiber molded body is coated with the binder solution without contact. In particular, the noncontact coating style is preferable.

The contact coating style is a coating method of the binder solution such that a coating member such as a coating roll supplied with the binder solution contacts a surface of the inorganic fiber molded body. In the contact coating style, a binder solution having a certain amount of viscosity is used since coating becomes uneven if the viscosity of the binder is low. Accordingly, the binder solution may have difficulty permeating to the inorganic fiber molded body.

Also, the noncontact coating style is a method such that a coating member such as a nozzle does not contact the inorganic fiber molded body. Permeating the binder solution to inside the inorganic fiber molded body by the noncontact coating style such as a spray method is more difficult than by the contact coating style.

In contrast, in the present invention, the inorganic fiber molded body is coated and impregnated with the liquid in the later described liquid coating step, so that the binder may be moved from the surface of the inorganic fiber molded body coated with the binder solution to the opposite side surface or the inside. Thus, the present invention is useful for applying the contact coating style and the noncontact coating style.

Examples of the contact coating style may include a kiss coating method, a roll coating method, and a gravure coating method. Above all, the kiss coating method is preferable. The reason therefore is that coating is possible by sliding a kiss roll so as to easily control the coating amount of the binder by a ratio of a surface velocity of the roller with respect to a line speed of the inorganic fiber molded body.

Also, examples of the noncontact coating style may include a spraying method, a die coating method, and a curtain coating method. Above all, the spraying method is preferable. The reason therefor is to control the coating amount of the binder solution without controlling a carrying speed and tensile strength of the inorganic fiber molded body when the inorganic fiber molded body is coated with the binder solution by a roll-to-roll style.

On the occasion of coating the inorganic fiber molded body with the binder solution, the binder solution may be coated on one surface of the inorganic fiber molded body, and may be coated on the both surfaces, but preferably coated on one surface above all. If the binder solution is coated on one surface of the inorganic fiber molded body, the binder solution may be moved from the surface of the inorganic fiber molded body coated with the binder solution to the opposite side surface by absorbing the liquid from the opposite side surface of the inorganic fiber molded body to the surface coated with the binder solution in the later described deliquoring step, so that the binder is further inhibited from localizing on the surface of the inorganic fiber molded body coated with the binder solution. Also, a hot air goes through the inorganic fiber molded body from the surface coated with the binder solution in the later described drying step, so that the migration of the binder at the time of drying thereof may be inhibited.

The coating amount of the binder solution on the inorganic fiber molded body is appropriately selected in accordance with factors such as the kind of the inorganic fiber and the binder solution, the concentration of the binder in the binder solution, the thickness of the binder-containing inorganic fiber molded body, and the usage, and the coating amount is appropriately adjusted so that the later described solid amount of the binder is in the desired range with respect to the inorganic fiber in the inorganic fiber molded body.

3. Liquid Coating Step

In the present invention, a liquid coating step of coating the inorganic fiber molded body coated with the binder solution with a liquid of which boiling point is less than 120° C., is conducted.

The boiling point of the liquid is less than 120° C., and preferably in a range of 60° C. to 110° C. The boiling point is in the range, so that the liquid may be easily removed in the later described drying step. Meanwhile, if the boiling point is too high, complete removal of the liquid in the later described drying step becomes difficult. Also, if the boiling point is too low, the evaporation speed of the liquid becomes fast, and thus sufficient permeation of the liquid to the inorganic fiber molded body becomes difficult; as the result, the inorganic fiber molded body could have difficulty containing the binder inside.

Also, the vapor pressure of the liquid at a room temperature (25° C.) is preferably low and specifically preferably 5 kPa or less. If the vapor pressure is too high, the evaporation speed of the liquid becomes fast, and thus sufficient permeation of the liquid to the inorganic fiber molded body becomes difficult; as the result, the inorganic fiber molded body could have difficulty containing the binder inside.

The viscosity of the liquid is preferably lower than the viscosity of the binder solution, specifically preferably 3.5 mPa·s or less, above all, preferably in a range of 3.0 mPa·s to 0.5 mPa·s, and particularly preferably in a range of 2.0 mPa·s to 0.5 mPa·s. If the viscosity of the liquid is lower than the viscosity of the binder solution, the liquid is permeated to the inorganic fiber molded body more easily than the binder solution, so that the binder may be easily moved on the occasion of coating the inorganic fiber molded body with the liquid. Meanwhile, if the viscosity of the liquid is too high, sufficient permeation of the liquid to the inorganic fiber molded body becomes difficult; as the result, the inorganic fiber molded body could have difficulty containing the binder inside. Also, if the viscosity of the liquid is too low, the liquid could go through the inorganic fiber molded body.

Here, the viscosity signifies the viscosity at 20° C., which is the value measured by a rotatory viscometer based on JIS 28803 (a method for measuring viscosity of a liquid).

The liquid is not particularly limited if it can be permeated to the inorganic fiber molded body, but is preferably the one satisfying the boiling point and the viscosity described above. Also, the liquid is preferably the one that does not deteriorate the conditions of the binder solution, specifically more preferably the solvent or dispersion medium included in the binder solution. The reason therefor is to easily move the binder when the inorganic fiber molded body is coated and impregnated with the liquid. Examples of such liquid may include water and lower alcohols such as ethanol. In specific, when a water dispersion type emulsion is used as the binder solution, water is preferably used as the liquid. Also, water is environmentally favorable. Examples of the water may include pure water. The liquid may be used in one kind alone, and may be used in a combination of two kinds or more.

Also, impurities included in the liquid are preferably as little as possible, and it is more preferable that the liquid does not include impurities. The liquid is to be completely removed in the later described drying step and is preferably not remained in the binder-containing inorganic fiber molded body to be obtained; thus, impurities are not preferably included.

Here, the liquid does not include impurities means that the concentration of impurities included in the liquid is 0.1 mass % or less.

The coating method of the liquid is not particularly limited if the method allows the liquid to uniformly coat the inorganic fiber molded body; examples thereof may include a spraying method, a curtain coating method, a die coating method, and a brush coating method. Above all, the coating method of the liquid is preferably a noncontact coating style. The liquid may be coated repeatedly multiple times.

Also, on the occasion of coating the inorganic fiber molded body with the liquid, the liquid may be coated on one surface of the inorganic fiber molded body, and may be coated on the both surfaces. Above all, the liquid is preferably coated on the surface of the inorganic fiber molded body coated with the binder solution. In this case, a binder concentration may be decreased on the surface of the inorganic fiber molded body coated with the binder solution; as the result, the segregation of the binder to the surface of the inorganic fiber molded body may be inhibited in the drying step. Also, the binder solution may be permeated to inside the inorganic fiber molded body along with the liquid being permeated from the surface of the inorganic fiber molded body coated with the binder solution to the inside, so that the binder may be uniformly contained in the thickness direction of the inorganic fiber molded body.

Also, on the occasion of coating one surface of the inorganic fiber molded body with the liquid, concurrently with the coating, the liquid is preferably absorbed from the opposite side surface of the inorganic fiber molded body to the surface coated with the liquid; above all, the liquid is preferably absorbed from the opposite side surface of the inorganic fiber molded body to the surface coated with the binder solution and the liquid concurrently with coating the liquid on the surface of the inorganic fiber molded body coated with the binder solution. Thereby, the permeation speed of the liquid may be faster. Also, the binder solution may be moved along with the liquid moving from the surface of the inorganic fiber molded body coated with the liquid to the opposite side surface, so that the inorganic fiber molded body may contain the binder uniformly in the thickness direction.

The coating amount of the liquid is not particularly limited if the amount is to the extent that allows the binder to move in the entire thickness direction of the inorganic fiber molded body, and is appropriately selected in accordance with factors such as the inorganic fiber, the kind of the binder solution and the liquid, the thickness of the binder-containing inorganic fiber molded body, and the usage. For example, the coating amount ratio of the liquid with respect to a solid amount of the binder on the surface of the inorganic fiber molded body coated with the binder solution is preferably in a range of 3.0 to 50, more preferably in a range of 4.0 to 40, and particularly preferably in a range of 5.0 to 30. If the coating amount of the liquid is too small, the equalization of the binder becomes difficult. Also, if the coating amount of the liquid is too large, the drying condition could be an excessive load.

In particular, if the solid amount of the binder in the binder-containing inorganic fiber molded body is 5 pts. mass or less with respect to 100 pts. mass of the inorganic fiber in the inorganic fiber molded body, the coating amount of the liquid with respect to the mass per inorganic fiber in the inorganic fiber molded body is preferably in a range of 7.5% to 80%, more preferably in a range of 10% to 60%, and further more preferably in a range of 12% to 40%. The coating amount of the liquid with respect to the mass per inorganic fiber in the inorganic fiber molded body is in the range, so that the dust generation amount of the binder-containing inorganic fiber molded body to be manufactured may be decreased, the shearing coefficient may be increased, the friction coefficient may be decreased, and the drying condition does not become an excessive load.

4. Deliquoring Step

In the present invention, it is preferable to conduct a deliquoring step of removing the liquid from the inorganic fiber molded body coated with the binder solution and the liquid, after the liquid coating step, before the later described drying step. The reason therefor is to easily remove the solvent and the dispersion medium of the binder solution in the later described drying step, and to shorten the drying time.

Examples of the method for deliquoring may include absorption, pressurization, and compression.

Above all, deliquoring by absorption is preferable; the preferable method is such that the binder solution and the liquid are coated on the same one surface of the inorganic fiber molded body respectively, and then the liquid is absorbed from the opposite side surface of the inorganic fiber molded body to the surface coated with the binder solution and the liquid. Thereby, the binder solution may be moved along with the liquid moving from the surface of the inorganic fiber molded body coated with the binder solution and the liquid to the opposite side surface, so that the inorganic fiber molded body may contain the binder uniformly in the thickness direction.

The method for deliquoring by absorption is not particularly limited if the method allows the liquid to be absorbed, and examples thereof may include a method of decompressing the opposite side surface of the inorganic fiber molded body to the surface coated with the liquid.

Also, in the case of deliquoring by pressurization, the surface of the inorganic fiber molded body coated with the liquid may be pressurized. The binder solution may be moved along with the liquid moving from the surface of the inorganic fiber molded body coated with the liquid to the opposite side surface.

The conditions for deliquoring such as the pressure during deliquoring and a deliquoring time are appropriately adjusted so as not to remove the binder in the binder solution.

5. Drying Step

In the present invention, usually, a drying step of drying the inorganic fiber molded body coated with the binder solution and the liquid is conducted after the liquid coating step.

Examples of the method for drying may include drying by heating, through-flow drying, drying under reduced pressure, centrifugal drying, suction drying, press drying, and natural drying. Above all, through-flow drying is preferable. The reason therefor is to shorten the drying time.

In the through-flow drying, usually, hot air is to be through the inorganic fiber molded body in the thickness direction. Above all, the hot air preferably goes through from the surface of the inorganic fiber molded body coated with the binder solution. If the hot air goes through from the surface of the inorganic fiber molded body coated with the binder solution to the thickness direction, the solvent and the dispersion medium of the binder solution and the liquid move in the thickness direction along with the hot air, and are vaporized at the same time, so that the migration can be inhibited. Accordingly, the binder is allowed to be remained contained inside the inorganic fiber molded body.

On the occasion of the through-flow drying, the inorganic fiber molded body is preferably pinched by a pair of ventilation members having air holes and then through-flow dried. The reason therefor is to dry the inorganic fiber molded body uniformly.

Examples of the material for the ventilation member may include metal and resin. Above all, it is preferable to use metal ventilation members for its high heat conductivity and ability for efficient drying.

Also, the ventilation members preferably have a number of holes. The drying time may be shortened thereby.

Also, on the occasion of the through-flow drying, the inorganic fiber molded body is preferably pinched by the ventilation members and then compressed. The reason therefor is to improve the bulk density of the inorganic fiber molded body.

The drying temperature is appropriately selected in accordance with factors such as the drying method and the kind of the binder solution and the liquid. For example, in the case of drying by heating and through-flow drying, the drying temperature may be a boiling point of the liquid or more, specifically, preferably in a range of 80° C. to 160° C., and particularly preferably in a range of 120° C. to 160° C. Too low drying temperature does not allow sufficient drying, and the cross linking of the binder could be insufficient thereby. On the other hand, too high drying temperature could deteriorate the binder, and a sudden evaporation of the solvent and the dispersion medium of the binder solution could occur to cause the migration.

Other conditions for drying such as the air amount to be through and the drying time are appropriately adjusted so that the liquid is removed from the inorganic fiber molded body, but the binder in the binder solution is not removed. For example, the drying time may be approximately from 10 seconds to 60 seconds.

Also, when an inorganic binder is used, usually, burning is conducted after drying. The conditions for burning may be appropriately selected from general conditions for burning in manufacturing methods for a binder-containing inorganic fiber molded body that contains an inorganic binder.

6. Binder-Containing Inorganic Fiber Molded Body

A binder-containing inorganic fiber molded body having an inorganic fiber molded body, and a binder contained in the inorganic fiber molded body can be obtained by the present invention.

The content of the binder in the binder-containing inorganic fiber molded body is not particularly limited, and is appropriately selected in accordance with factors such as the kind of the inorganic fiber and the binder, the thickness of the binder-containing inorganic fiber molded body, and the usage. For example, the solid amount of the binder in the binder-containing inorganic fiber molded body with respect to 100 pts. mass of the inorganic fiber in the inorganic fiber molded body is preferably in a range of 0.5 pts. mass to 10.0 pts. mass. If the solid amount of the binder is too small, the desired thickness of the binder-containing inorganic fiber molded body could not be obtained, and if the amount is too large, the cost increases. Also, in the case of an organic binder, if the solid amount of the organic binder is large, the organic binder could not be easily decomposed, and the working environment could be degraded due to the gas caused by the decomposition of the organic binder. Also, in the case of an inorganic binder, if the solid amount of the inorganic binder is large, the cushioning property could be degraded.

The binder-containing inorganic fiber molded body may be applied to materials such as heat insulators, refractory materials, cushions (holding materials), and seal materials. Above all, the binder-containing inorganic fiber molded body is favorable as a holding material for an exhaust gas purifier. In the present invention, the binder-containing inorganic fiber molded body has a high shear strength and a low friction resistance to a casing, so that the assembling properties are excellent and the slippage of the binder-containing fiber molded body and a catalyst support or a particle filter when being pressed-in can be inhibited therein, and thus the holding properties of the binder-containing fiber molded body can be improved. The exhaust gas purifier is provided with a catalyst support or a particle filter, a casing made of metal for storing the catalyst support or the particle filter, and a packing material installed between the catalyst support or the particle filter and the casing. Specific examples thereof may include a catalytic converter and a diesel particular filter (DPF).

The constitution of the exhaust gas purifier is not particularly limited, and the binder-containing inorganic fiber molded body of the present invention can be applied for general exhaust gas purifiers provided with the above-described constitutions.

The present invention is not limited to the embodiments. The embodiments are exemplification, and other variations are intended to be included in the technical scope of the present invention if they have substantially the same constitution as the technical idea described in the claims of the present invention and have similar operation and effect thereto.

EXAMPLES

The present invention will be hereinafter described in further details with reference to examples and comparative examples.

[Evaluations]

(Dust Generation Amount)

First, a 75 mm×75 mm test piece was cut out with a die to produce a measurement sample for a dust generation amount. Next, the measurement sample for a dust generation amount was pounded by a stainless steel plate (3 mm thick, a conductive sheet (1 mm) adhered to the surface contacting the measurement sample) bonded with an acrylic plate (5 mm thick), with a constant strength, 100 times with 1.5 seconds intervals for each surface (total 200 times). The mass difference between before and after pounding the measurement sample was determined as the dust generation amount (mg/75 mm□).

(Friction Coefficient)

Figure 3:
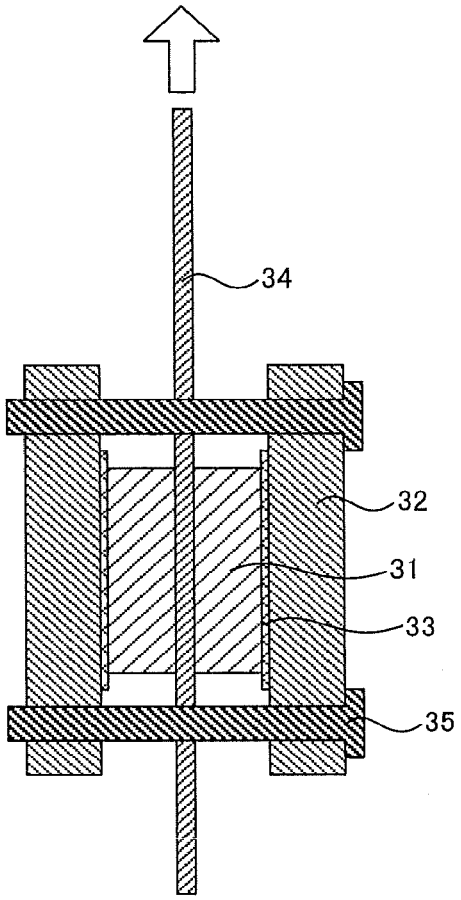
FIG. 3 is a schematic side view illustrating a measurement device of a friction coefficient.

FIG. 3 is a schematic side view schematically illustrating the measurement device of a friction coefficient.

First, 40 mm×40 mm test pieces were cut out with a die to produce two measurement samples for a friction coefficient (31). Next, the measurement samples for a friction coefficient (31) were adhered to a pair of stainless steel plates (32) respectively by adhesive tapes (33) (manufactured by NICHIBAN CO., LTD., NICETACK™ NW-40 (for general use)). After that, the stainless steel plates (32) were placed so that a stainless sheet for a tension test (34) (EN 1.4509 surface treatment 2B finish) was interposed between the measurement samples for a friction coefficient (31). The width between the stainless steels was appropriately adjusted by a width adjusting fastener (35) so that the bulk density of the inorganic fibers in the measurement samples for a friction coefficient (31) became 0.375 g/cm$^3$.

After that, the stainless sheet for a tension test (34) was connected to a measurement device (Technograph TG) at a room temperature (25° C.), and pulled at a speed of 1000 mm/min to measure the peak load F. The peak load obtained from the measured peak load F (N) and vertical forces N (N) working on the surface where the stainless sheet for a tension test (34) contacts the measurement samples for a friction coefficient (31) (in the present measurement, a surface pressure H (N) measured after 5 minutes the bulk density of the inorganic fibers was fixed to be 0.375 g/cm$^3$) signifies that the friction forces of two measurement samples for a friction coefficient were measured; thus, a friction coefficient "p," was calculated by the following formula.

$$\mu=F/2N$$

(Shearing Coefficient)

A shearing coefficient was measured in the same manner as in the measurement method for the friction coefficient except that the measurement samples for a friction coefficient (31) were further adhered to the stainless sheet for a tension test (34) adhesive tapes (33) in the measurement device for a friction coefficient shown in FIG. 3. On that occasion, based on the measured peak load S (N) and the surface pressure H (N) measured after 5 minutes the bulk density of the inorganic fibers was fixed to be 0.375 g/cm$^3$, a shearing coefficient "a" was calculated by the following formula.

$$\alpha=S/2H$$

(Adhered Amount of Solid Binder)

Regarding the adhered amount of the solid binder per inorganic fiber in the inorganic fiber molded body, the content of the binder was measured by burning the binder-containing inorganic fiber molded body at 800'C for 1 hour to burn down the binder, and comparing the mass after burning to the mass before burning. The adhered amount of the solid binder was calculated by "(the mass of the binder-containing inorganic fiber molded body before burning−the mass of the binder-burned-down inorganic fiber molded body after burning)/the mass of the binder-burned-down inorganic fiber molded body after burning×100".

The adhered amount of the solid binder corresponded to the solid amount of the binder in the binder solution of the inorganic fiber molded body, on the occasion of manufacturing the binder-containing inorganic fiber molded body.

Example 1

Using an alumina fiber molded body original fabric roll (product name: MAFTEC (registered trademark), manufactured by Mitsubishi Plastics, Inc., basis weight 1200 g/m$^2$), by the manufacturing method shown in FIG. 2, in the binder solution coating step, an acrylate-based latex (product name: Nipol (registered trademark), manufactured by ZEON CORPORATION, concentration 10%) was sprayed by a spray, so that the adhered amount of the solid binder became 1.0% (intended value) with respect to the mass per inorganic fiber in the inorganic fiber molded body.

Next, in the liquid coating step, ion exchanged water was sprayed by a spray from the surface coated with the latex, so that the coated amount of the ion exchanged water became 15.0% with respect to the mass per inorganic fiber in the inorganic fiber molded body.

After that, the deliquoring step (absorbing speed 4.5 m/sec.) and the drying step by throw-flow drying (160° C., for 30 seconds, speed 0.95 m/sec.) were conducted to produce a binder-containing inorganic fiber molded body, which was thereafter collected and cut into a specific size to conduct the evaluations. The result is shown in Table 1.

Example 2

A binder-containing inorganic fiber molded body was produced and evaluated in the same manner as in Example 1, except that the water was sprayed by a spray from the surface coated with the latex in the liquid coating step, so that the coated amount of the water became 30.0% with respect to the mass per inorganic fiber in the inorganic fiber molded body. The result is shown in Table 1.

Example 3

A binder-containing inorganic fiber molded body was produced and evaluated in the same manner as in Example 2, except that the latex was sprayed by a spray in the binder solution coating step, so that the adhered amount of the solid binder became 2.0% (intended value) with respect to the mass per inorganic fiber in the inorganic fiber molded body. The result is shown in Table 1.

Example 4

A binder-containing inorganic fiber molded body was produced and evaluated in the same manner as in Example 3, except that the water was sprayed by a spray from the surface coated with the latex in the liquid coating step, so that the coated amount of the water became 60.0% with respect to the mass per inorganic fiber in the inorganic fiber molded body. The result is shown in Table 1.

Example 5

A binder-containing inorganic fiber molded body was produced and evaluated in the same manner as in Example 1, except that the latex was sprayed by a spray in the binder solution coating step, so that the adhered amount of the solid binder became 4.0% (intended value) with respect to the mass per inorganic fiber in the inorganic fiber molded body, and the water was sprayed by a spray from the surface coated with the latex in the liquid coating step, so that the coated amount of the water became 22.7% with respect to the mass per inorganic fiber in the inorganic fiber molded body. The result is shown in Table 1.

Example 6

A binder-containing inorganic fiber molded body was produced and evaluated in the same manner as in Example 5, except that the latex was sprayed by a spray in the binder solution coating step, so that the adhered amount of the solid binder became 2.5% (intended value) with respect to the mass per inorganic fiber in the inorganic fiber molded body. The result is shown in Table 1.

Comparative Example 1

A binder-containing inorganic fiber molded body was produced and evaluated in the same manner as in Example 1, except that the liquid coating step was not conducted, and the drying step was conducted by ventilation drying (160° C., for 30 seconds). The result is shown in Table 1.

Comparative Example 2

A binder-containing inorganic fiber molded body was produced and evaluated in the same manner as in Example 3, except that the liquid coating step was not conducted, and the drying step was conducted by ventilation drying (160° C., for 30 seconds). The result is shown in Table 1.

Comparative Example 3

A binder-containing inorganic fiber molded body was produced and evaluated in the same manner as in Example 5, except that the liquid coating step was not conducted, and the drying step was conducted by ventilation drying (160° C., for 30 seconds). The result is shown in Table 1.

Comparative Example 4

A binder-containing inorganic fiber molded body was produced and evaluated in the same manner as in Example 1 except that the liquid coating step was not conducted. The result is shown in Table 1.

Comparative Example 5

A binder-containing inorganic fiber molded body was produced and evaluated in the same manner as in Example 3 except that the liquid coating step was not conducted. The result is shown in Table 1.

Comparative Example 6

A binder-containing inorganic fiber molded body was produced and evaluated in the same manner as in Example 5 except that the liquid coating step was not conducted. The result is shown in Table 1.

Comparative Example 7

A binder-containing inorganic fiber molded body was produced and evaluated in the same manner as in Example 6, except that an acrylate-based latex with a concentration of 5.2% was used in the binder solution coating step, the latex was sprayed by a spray so that the adhered amount of the solid binder became 2.5% (intended value) with respect to the mass per inorganic fiber in the inorganic fiber molded body, and the liquid coating step was not conducted. That is, the amount of water with respect to the mass per inorganic fiber in the inorganic fiber molded body in Comparative Example 7 is the same as in Example 6, although the liquid coating step was not conducted in Comparative Example 7. The result is shown in Table 1.

TABLE 1

| | Manufacturing steps | | | | | | | | |
|---|---|---|---|---|---|---|---|---|---|
| | Binder solution coating | | Liquid coating | | | | Dust | | |
| | Adhered amount of solid binder (%) | Latex concentration (%) | Coated amount (%) | Coated amount ratio Water/Latex | Deliquoring | Drying | generation amount (mg/75 mm□) | Shearing coefficient | Friction coefficient |
| Example 1 | 1.1 | 10 | 15.0 | 13.6 | Conducted | Through-flow | 26.3 | 0.373 | 0.180 |
| Example 2 | 1.2 | 10 | 30.0 | 25.0 | Conducted | Through-flow | 25.7 | 0.356 | 0.186 |
| Example 3 | 2.2 | 10 | 30.0 | 13.6 | Conducted | Through-flow | 21.7 | 0.350 | 0.186 |
| Example 4 | 2.1 | 10 | 60.0 | 28.6 | Conducted | Through-flow | 22.4 | 0.335 | 0.187 |
| Example 5 | 4.5 | 10 | 22.7 | 5.0 | Conducted | Through-flow | 9.8 | 0.389 | 0.196 |

TABLE 1-continued

| | Manufacturing steps | | | | | | | | |
|---|---|---|---|---|---|---|---|---|---|
| | Binder solution coating | | Liquid coating | | | | Dust | | |
| | Adhered amount of solid binder (%) | Latex concentration (%) | Coated amount (%) | Coated amount ratio Water/Latex | Deliquoring | Drying | generation amount (mg/75 mm□) | Shearing coefficient | Friction coefficient |
| Example 6 | 3.0 | 10 | 22.7 | 7.6 | Conducted | Through-flow | 15.6 | 0.369 | 0.212 |
| Comparative Example 1 | 1.0 | 10 | None | — | Conducted | Ventilation | 31.1 | 0.349 | 0.289 |
| Comparative Example 2 | 1.8 | 10 | None | — | Conducted | Ventilation | 29.2 | 0.314 | 0.245 |
| Comparative Example 3 | 3.8 | 10 | None | — | Conducted | Ventilation | 22.9 | 0.300 | 0.257 |
| Comparative Example 4 | 1.0 | 10 | None | — | Conducted | Through-flow | 38.9 | 0.394 | 0.261 |
| Comparative Example 5 | 1.8 | 10 | None | — | Conducted | Through-flow | 23.2 | 0.360 | 0.244 |
| Comparative Example 6 | 3.8 | 10 | None | — | Conducted | Through-flow | 18.5 | 0.359 | 0.255 |
| Comparative Example 7 | 3.0 | 5.2 | None | — | Conducted | Through-flow | 13.1 | 0.369 | 0.237 |

Consideration

From the results, comparing the binder-containing inorganic fiber molded bodies in Examples to those in Comparative Examples, in those in Examples, the dust generation amount was less, intercalation occur less easily (the shearing coefficient was higher), and friction with the casing made of metal during pressing-in was less (the friction coefficient was lower); thus, those in Examples were found to be suitable as a holding material to be used for a catalyst support.

In particular, comparing Example 6 to Comparative Example 7, it was not beneficial to include much water at the time of coating the binder solution, but it was found out that coating the liquid additionally in the liquid coating step brought the effect.

REFERENCE SIGNS LIST

1 . . . inorganic fiber molded body
2 . . . binder solution
3 . . . liquid
4*a* . . . surface coated with binder solution
4*b* . . . opposite side surface to surface coated with binder solution
5 . . . binder
6 . . . binder-containing inorganic fiber molded body

The invention claimed is:

1. A method for manufacturing a binder-containing, inorganic fiber molded body, comprising:

coating an inorganic fiber molded body with a binder solution comprising: a binder; and a solvent or a dispersion medium; and after the coating of the inorganic fiber molded body with the binder solution is completed, coating the inorganic fiber molded body with a liquid having a boiling point of less than 120° C., wherein the liquid consists of the solvent or the dispersion medium included in the binder solution.

2. The method of claim 1, wherein the liquid is coated on a surface of the inorganic fiber molded body coated with the binder solution.

3. The method of claim 2, further comprising:

drying the inorganic fiber molded body coated with the binder solution after coating with the liquid, wherein the drying is through-flow drying.

4. The method of claim 2, wherein the binder solution and the liquid are applied to a first surface of the inorganic fiber molded body, and the method further comprises: sucking the liquid from a second surface opposite to the first surface of the inorganic fiber molded body, after coating the inorganic fiber molded body with the liquid, such that the binder solution and the liquid are moved from the first surface to the second surface and the binder distribution is equalized throughout the inorganic fiber molded body.

5. The method of claim 4, wherein the binder solution is applied by a noncontact coating method.

6. The method of claim 4, wherein a mass ratio of an amount of the coated liquid to a solid amount of the coated binder solution on a surface of the inorganic fiber molded body, wherein the surface is coated with the binder, is in a range of 3.0 to 50.

7. The method of claim 4, wherein a coating amount of the liquid is in a range of 7.5% to 80% with respect to the mass per inorganic fiber in the inorganic fiber molded body.

8. The method of claim 4, wherein the liquid is water or a lower alcohol.

9. The method of claim 4, wherein the liquid is water.

10. The method of claim 2, wherein the binder solution is applied by a noncontact coating method.

11. The method of claim 2, wherein a mass ratio of an amount of the coated liquid to a solid amount of the coated binder solution on a surface of the inorganic fiber molded body, wherein the surface is coated with the binder, is in a range of 3.0 to 50.

12. The method of claim 2, wherein a coating amount of the liquid is in a range of 7.5% to 80% with respect to the mass per inorganic fiber in the inorganic fiber molded body.

13. The method of claim 2, wherein the liquid is water or a lower alcohol.

14. The method of claim 2, wherein the liquid is water.

15. The method of claim 1, further comprising:

drying the inorganic fiber molded body coated with the binder solution after coating with the liquid, wherein the drying is through-flow drying.

16. The method of claim 1, wherein the binder solution and the liquid are applied to a first surface of the inorganic fiber molded body, and the method further comprises: sucking the liquid from a second surface opposite to the first surface of the inorganic fiber molded body, after coating the inorganic fiber molded body with the liquid, such that the binder solution and the liquid are moved from the first surface to the second surface and the binder distribution is equalized throughout the inorganic fiber molded body.

17. The method of claim 1, wherein the binder solution is applied by a noncontact coating method.

18. The method of claim 1, wherein a mass ratio of an amount of the coated liquid to a solid amount of the coated binder solution on a surface of the inorganic fiber molded body, wherein the surface is coated with the binder, is in a range of 3.0 to 50.

19. The method of claim 1, wherein a coating amount of the liquid is in a range of 7.5% to 80% with respect to the mass per inorganic fiber in the inorganic fiber molded body.

20. The method of claim 1, wherein the liquid is water or a lower alcohol.

* * * * *